United States Patent [19]

Corey

[11] Patent Number: 4,582,126

[45] Date of Patent: Apr. 15, 1986

[54] HEAT EXCHANGER WITH CERAMIC ELEMENTS

[75] Inventor: John A. Corey, North Troy, N.Y.

[73] Assignee: Mechanical Technology Incorporated, Latham, N.Y.

[21] Appl. No.: 605,785

[22] Filed: May 1, 1984

[51] Int. Cl.[4] ..... F28F 7/02; F28F 3/08

[52] U.S. Cl. ..... 165/82; 165/145; 165/166; 165/905

[58] Field of Search ..... 165/145, 81, 82, 83, 165/DIG. 8, 69, 76, 165, 166, 125, 144

[56] References Cited

U.S. PATENT DOCUMENTS

| | | | |
|---|---|---|---|
| 2,729,432 | 1/1956 | Berg | 165/145 |
| 3,166,122 | 1/1965 | Hryniszak | 165/139 |
| 3,285,326 | 11/1966 | Wosika | 165/145 |
| 3,889,744 | 6/1975 | Hill et al. | 165/83 |
| 4,044,825 | 8/1977 | Gugenberger et al. | 165/165 |
| 4,077,215 | 3/1978 | Reams et al. | 165/165 |
| 4,083,400 | 4/1978 | Dziedzic et al. | 165/82 |
| 4,085,588 | 4/1978 | Reams et al. | 165/166 |
| 4,262,740 | 4/1981 | Brune | 165/82 |
| 4,279,297 | 7/1981 | Dziedzic et al. | 165/165 |
| 4,333,522 | 6/1982 | Brune | 165/145 |
| 4,503,904 | 3/1985 | Newman et al. | 165/82 |

FOREIGN PATENT DOCUMENTS

| | | | |
|---|---|---|---|
| 2301222 | 7/1974 | Fed. Rep. of Germany | 165/166 |
| 2288287 | 5/1976 | France | 165/165 |
| 1078868 | 8/1967 | United Kingdom | 165/165 |

*Primary Examiner*—William R. Cline
*Assistant Examiner*—John K. Ford
*Attorney, Agent, or Firm*—Joseph V. Claeys; Charles W. Helzer

[57] ABSTRACT

An annular heat exchanger assembly includes a plurality of low thermal growth ceramic heat exchange members with inlet and exit flow ports on distinct faces. A mounting member locates each ceramic member in a near-annular array and seals the flow ports on the distinct faces into the separate flow paths of the heat exchanger. The mounting member adjusts for the temperature gradient in the assembly and the different coefficients of thermal expansion of the members of the assembly during all operating temperatures.

3 Claims, 7 Drawing Figures

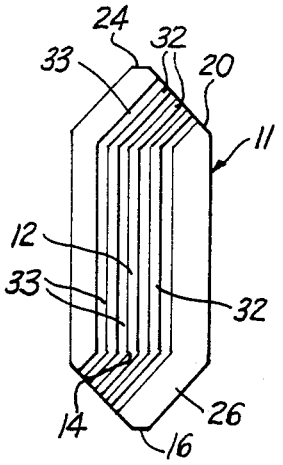
Fig. 1A
Fig. 1
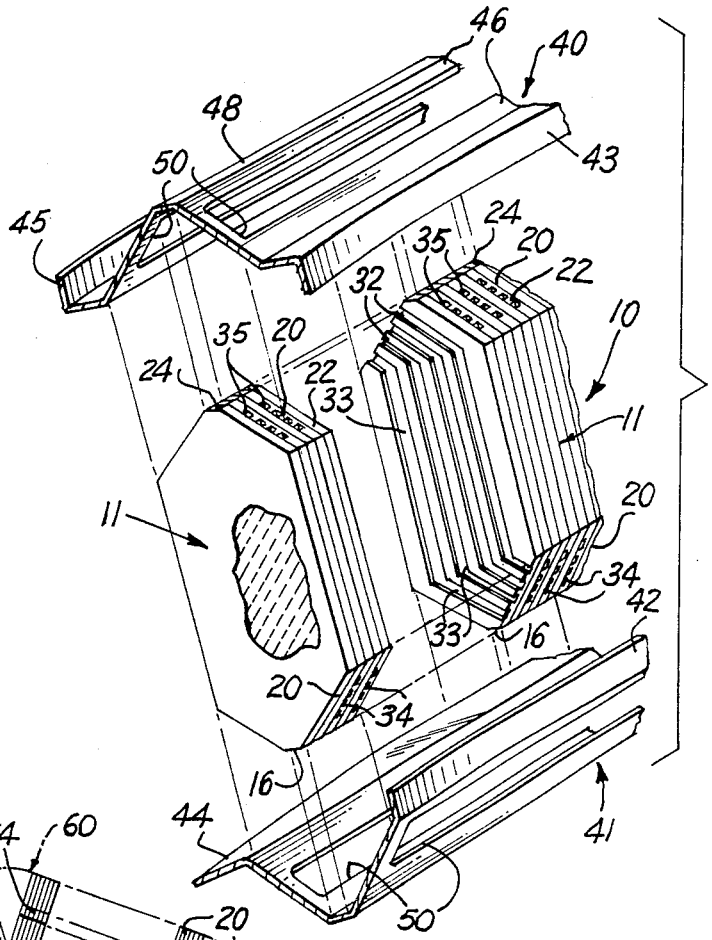
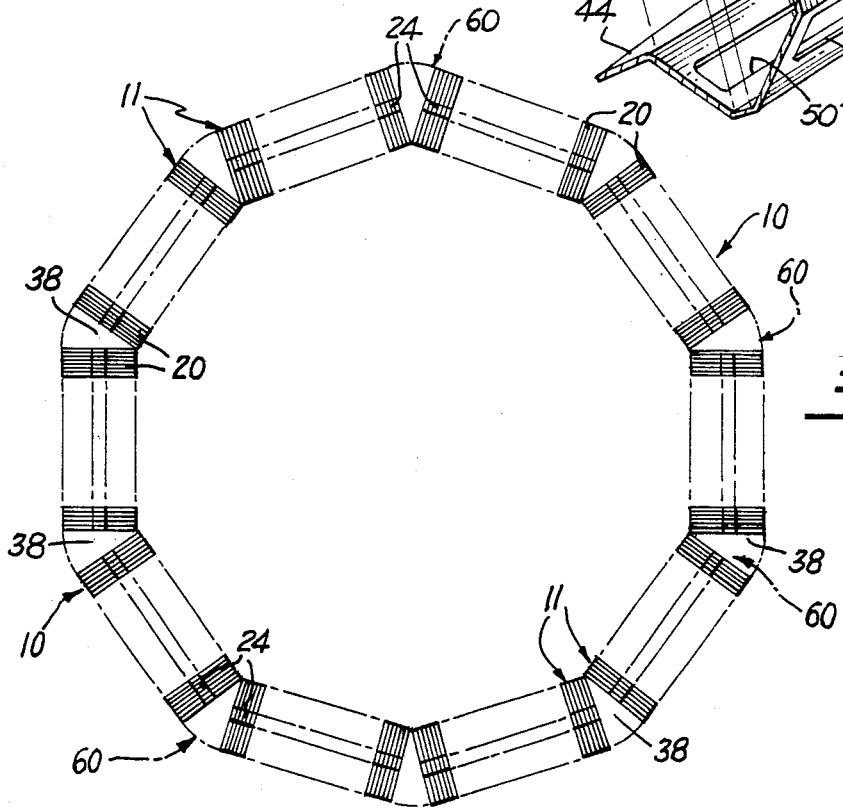
Fig. 2

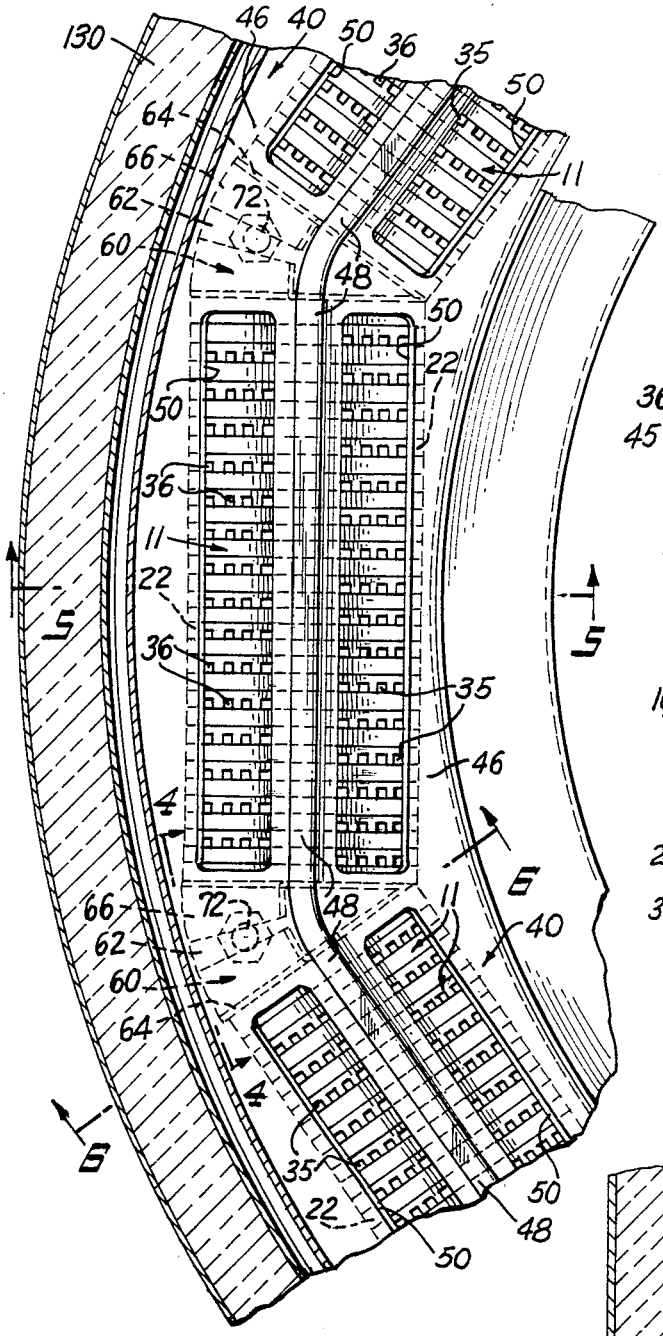
Fig. 3
Fig. 4
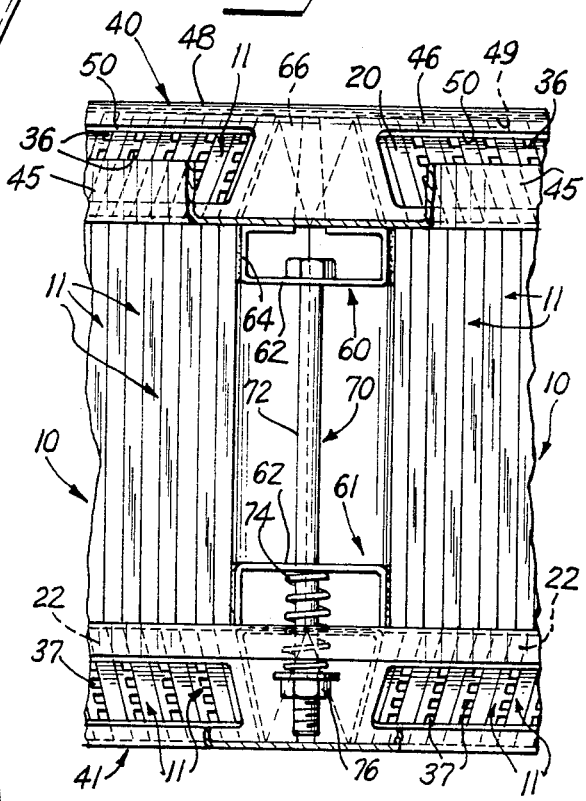
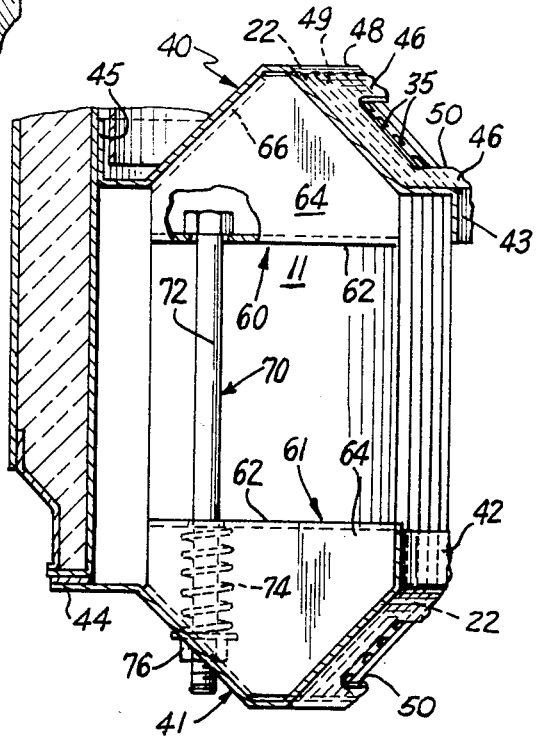
Fig. 6

HEAT EXCHANGER WITH CERAMIC ELEMENTS

The Government of the United States of America has rights in this invention pursuant to Contract DEN3-32 awarded by the U.S. Department of Energy.

FIELD OF THE INVENTION

This invention relates generally to heat exchangers and more particularly to heat exchangers of annular configuration which utilize ceramic materials and which are especially advantageous for use as preheaters in hot gas Stirling type engines.

BACKGROUND OF THE INVENTION

The desirability of using ceramic materials in heat exchangers has been recognized, however, attempts to provide practical, effective, long life, low cost and reliable heat exchangers of annular configuration employing ceramic materials have not heretofore been entirely successful. Among the difficulties encountered are those relating to maintaining a long-lived and effective seal between the ceramic materials and the metallic mounting means therefor. This is due, in part at least, to the different coefficients of thermal expansion of the different materials. To operate efficiently, the two fluid streams of a heat exchanger must be isolated from each other and not allowed to leak. Leakage has typically been a problem at the interface of the near zero thermal growth ceramic material and the metallic mounting means.

Moreover, another sealing difficulty arises when attempting to provide heat exchangers of annular configuration using ceramic materials. A low cost, continuously annular ceramic construction is not possible with current processing techniques. A low cost and desirable ceramic heat exchanger element that can be readily used is a pre-assembled block made from a plurality of suitably configured ceramic plates stacked together. When such blocks are arranged in a near-annular array as required for a heat exchanger of annular configuration such blocks do not form a continuous circle of ceramic material. The gaps between the blocks introduce additional sealing problems.

SUMMARY OF THE INVENTION

An object of this invention is to provide a heat exchanger assembly which reduces the cost of fabrication, allows higher operating temperatures, and provides light-weight construction and efficient heat transfer.

Another object of this invention is to provide an annular heat exchanger assembly which can be readily constructed of pre-assembled ceramic blocks and in which the fluid streams can be positively sealed to provide better performance.

Another object of this invention is to provide a heat exchanger assembly which can accommodate a different coefficient of thermal expansion between the mounting means and the heat exchange matrix.

Another object of this invention is to provide a counterflow heat exchanger assembly which eliminates leakage between the counterflowing fluids during all operating temperatures.

Another object of this invention is to provide a counterflow heat exchanger assembly which can accommodate a thermal gradient between the low temperature end and the high temperature end of the heat exchanger while providing effective sealing at the inlet and exit flow ports.

BRIEF DESCRIPTION OF THE DRAWINGS

These and other objects, features and many of the attendant advantages of this invention will be better understood upon reading of the following detailed description when considered in conjunction with accompanying drawings, wherein similar elements of the several figures are identified by the same reference character, and wherein:

FIG. 1 is a partially exploded view of a ceramic member showing examples of the ceramic plates used to construct a heat exchange matrix and showing fragmentary sections of top and bottom clamping plates;

FIG. 1A is a side view of a ceramic plate;

FIG. 2 is a top view of the polygonal array of ceramic blocks;

FIG. 3 is a top view of a clamping plate showing an outline of the channel portion and clip assemblies;

FIG. 4 is a fragmentary elevation view looking radially inward in FIG. 3;

FIG. 6 is a sectional view along line 6—6 of FIG. 3.

DETAILED DESCRIPTION OF THE PREFERRED EMBODIMENTS

Figure 5:
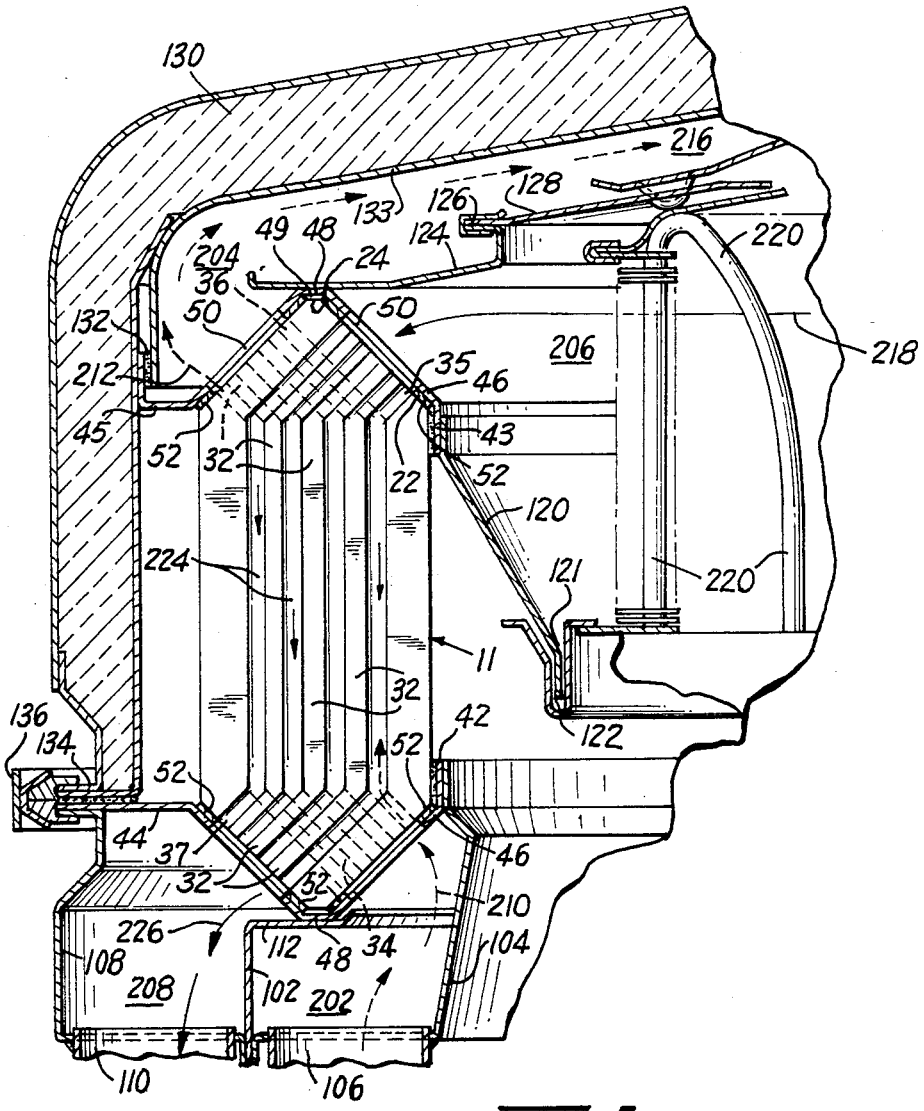
FIG. 5 is a fragmentary vertical sectional view along lines 5—5 of FIG. 3.

In a typical two stream heat exchanger, heat is exchanged between the fluids in the separate flow paths by the surfaces of the heat exchange matrix. The heat exchange matrix has four flow ports, including a first fluid inlet and exit and a second fluid inlet and exit. For the best performance of the heat exchanger, the flow ports should be isolated from each other so there is no leakage between fluids of different temperatures.

Member 10 of FIG. 1 illustrates one embodiment of a two-stream, stacked-plate heat exchange matrix which is readily fabricated at low cost. The matrix is constructed of individual ceramic plates 11 that are fused into the ceramic member or block 10. Using ceramic plates and a fusing process avoids the high fabrication cost associated with a metal plate construction. The assembled member 10 is substantially a hexagonal prism with four oblique faces 20, one for each of the flow ports 34–37 located therein. Top and bottom ridges 24 separate adjoining oblique faces.

As shown in FIG. 1A, each ceramic plate 11 has a profile with a rectangular body section 12 and top and bottom peaked sections 14. The peaked sections of each plate have a squared off or truncated portion at 16 that forms the ridge 24 in the assembled block.

The block 10 has internal flow passages that provide a matrix for the heat exchange between the two fluids. One embodiment of a plate that can be stacked to form flow passage is shown by the plate 11 of FIG. 1A. Each plate has one flat surface (not shown) and an opposite surface with channels 33 formed between raised ribs 32. The two boundary portions 26 along the edges of the plate 11 establish a general flow pattern and seal against an adjacent plate. The channels 33 are open-ended on the plate edges between the two boundary portions 26. Each plate in the stack is the mirror image of the adjacent plate. The channels in the assembled plates form flow passages through the ceramic member 10. The open ends of the channels from first fluid inlet flow ports 34, second fluid inlet flow ports 35, first fluid exit flow ports 36, and second fluid exit flow ports 37 on the center portion of the oblique faces 20 of the hexagonal prism. On each oblique face 20 there is a continuous flat sealing surface portion 22 surrounding the flow ports.

The thickness of the plate 11 has been exaggerated in the drawings for the sake of clarity. Likewise, the ribs 32 and channels 33 of FIG. 1A have been only schematically shown. In an actual plate, the ribs are very thin and close together to effect more flow channels and heat exchange. The boundary portions 26 and ribs 33 are oriented to produce the desired flow pattern, such as in the embodiment shown in FIG. 1A wherein each stream enters and exits at diagonally opposite edges. Other flow patterns are possible such as each stream entering and exiting at longitudinally opposite edges but on the same side of a plate.

A ceramic heat exchange matrix such as described above is readily fabricated in a hexagonal prism shape. A heat exchanger in an annular configuration is desired for many uses. In hot gas Stirling type engines for example, a circular combustion chamber is usually located at the center of the engine and is concentrically surrounded by an annular array of heater head tubes. The hot combustion gases flow through the heater head tubes and exchange heat to the sealed working fluid therein. To best utilize the remaining heat of the combustion gases, a counterflow preheater concentrically surrounds the annular heater head tubes. To approximate the annular configuration most desired, the ceramic members 10 are arranged in a regular polygon as shown in FIG. 2. However, trapezoidal gaps 38 are left between the members.

In order to mount the individual ceramic members 10 in a nearly annular array, top and bottom clamping plates (compression members) 40 and 41, respectively are provided, as illustrated in FIGS. 1 and 3. The clamping plates 40 and 41 are ring shaped and substantially flat at the inner and outer ring edges. A continuous channel 46 with a vee shape cross section is formed in the central portion of each clamping plate 40 and 41. The cross section of the channels 46 substantially conforms to the vee shape of the peaked sections 14 of the ceramic members 10. The cross section of the channel has a squared-off portion 48 to assist in fabrication. The channel 46 is of sufficient width and pitch such that two adjoining oblique faces 20 closely fit the vee shape cross section of the channel 46.

The channels 46 in the ring shaped clamping plates 40 and 41 have substantially the same polygon outline as the array of members 10, although the channel corners are rounded to assist in fabrication. The chord lines at the squared-off portion 48 of the channels are of sufficient length and straightness to accept the ceramic members 10.

The top clamping plate 40 has an annular inside flange 43 and an annular outside flange 45. The bottom plate 41 has an annular inside flange 42 and an annular outside flange 44. The flanges ae disposed at the inner and outer ring edges.

As illustrated in FIG. 5, a ceramic member 10 is held between top and bottom clamping plates 40 and 41. The oblique faces 20 of the ceramic member are adjacent the walls of the vee shaped channels 46. The ceramic members are seated in the channels 46 such that there is a small clearance 49 between the ridge 24 of the ceramic member and the squared off portion 48 of the channel.

The vee shaped channels 46 are provided with apertures 50 adjacent the flow ports 34–37 on the oblique faces of the ceramic members 10 to provide flow access to the flow parts. The area of the apertures 50 in the channel are slightly smaller than the area of the flow ports 34–37 on the oblique faces. Thus a portion of the walls of the channel 46 that surrounds the aperture interfaces with the sealing surface portion 22 that surrounds the flow ports 34–37 of the oblique faces. Gasket material 52 such as a ceramic fiber paper is placed at the interface of the metallic channel 46 and the sealing surface portion 22 of the oblique ceramic faces. The gasket material prevents leakage between the ceramic block 10 and the metallic mounting means 40 and 41.

As illustrated in FIGS. 4 and 6, top and bottom bolt clip assemblies 60 and 61 respectively, are adapted to fit the trapezoidal gaps 38 between the adjacent ceramic blocks in the array. The clip assemblies may be fabricated from a single metal sheet cut and bent to shape. Each assembly includes a horizontal ring segment 62 shaped to fit the gap 38. Attached perpendicular to the ring segments are wall portions 64 that extend longitudinally outward. The outward extending edge of the wall portions (away from the edge attached to the ring segments) have a peaked shape that conforms to the V cross-section of the channel 46. A perpendicular roof portion 66 is attached at each outward extending edge of the peaked shaped wall portion.

Two bolt clip assemblies are fitted into the gap 38 between blocks 10 such that the ring segments 62 are located a small distance longitudinally inward of the clamping plates 40 and 41. The wall portions 64 have a peaked shape which conforms to the profile of the ceramic member 10 and abuts the peaked portion of the ceramic member. The wall portions 64 serve to positively locate the ceramic members 10 in the array. Additionally, the wall portions 64 hold the gasket material 52 at the interface. The roof portion 66 abuts the walls of the channel 46 of the clamping plate and is attached thereto by welding or similar means.

A spring loaded bolt and nut assembly 70 holds the clamping plates together and holds the channels 40 attached thereto in compression against each pair of adjoining oblique faces 20. A bolt 72 is inserted through holes in the top and bottom ring segments 62. A spring 74 is placed over the threaded portion of the bolt to abut against the outside of one ring segment 62. A nut 76 or other restraining devices is screwed onto the threaded portion and is tightened to put the spring in compression. The ring segments 62 are pulled together and the attached clamping plates 40 and 41 hold the ceramic members 10 in compression. The tension on the bolt can be adjusted so that it is not relaxed by the difference of the thermal growth between the ceramic block and the bolt. Thus the ceramic members 10 will be held in compression by the clamping plates inspite of the thermal growth.

The difference coefficient of thermal expansion of the metallic clamping plates 40 and 41 and the ceramic member 10 will cause the clamping plates 40 and 41 to grow more than the ceramic against which it must seal. By making the ceramic member with a ridge 24, a small clearance space 49 is provided between the ceramic block 10 and the squared-off portion 48 of the clamping plate channel 46. This small clearance space allows the metal clamping plates 40 and 41 to grow on both sealing surfaces 22 of the oblique faces. The spring tension of the spring loaded bolt assemnbly 70 pulls the clamping plates 40 and 41 together against the gasket material 52 and the sealing surfaces 22 of the oblique faces of the ceramic member 10. The only relative motion then is some sliding along the oblique faces by the walls of the vee shape channel 46. The gasket material 52 at the interface of the metallic channel 46 and the ceramic member 10 continues to seal the flow ports 34–37 by deforming with the relative motion.

FIG. 5 illustrates one embodiment of the heat exchanger of this invention for use as a counterflow preheater in a Stirling type hot gas engine. Examples of such external combustion, hot gas engines are set forth in U.S. Pat. No. 3,940,934, issued Mar. 2, 1976, U.S. Pat. No. 4,261,173 issued Apr. 14, 1981, and U.S. Pat. No. 4,417,443 issued Nov. 29, 1983.

The annular heat exchanger assembly is supported in the engine by and in sealed air and exhaust fluid flow communication with annular manifold members which are attached to the clamping plates. An annular manifold common wall 102 is attached to the engine block (not shown) and extends generally upward. An annular air manifold ring 104 is attached to the manifold common wall 102 and extends radially inward and up from the common wall 102. Air manifold pipes 105 provides flow communication from an air blower (not shown). An annular exhaust manifold ring 108 is attached to the common wall 102 and extends radially outward and up from the common wall 102. Exhaust pipes 110 provide flow communication to the outside.

The bottom annular clamping plate 41 is positioned on an annular horizontal portion 112 of the annular manifold common wall 102. The squared-off portion 48 of the channel 46 sits on the horizontal portion 112 of the common wall and is welded into place. An annular bottom inside flange 42 of the clamping plate 41 is welded to the air manifold ring 104. An annular bottom outside flange 44 of the clamping plate 41 rests on the exhaust manifold ring 108.

The bottom bolt clip assemblies 61 are welded into the channel 46 of the bottom clamping plate 41 at the proper places. The ceramic members 10 are placed in the bottom channel in a near annular array such that the members 10 tightly fit between the bolt clip assemblies.

The top clamping plate 40 is prepared prior to being placed on top of the annular array. The bolts 72 are placed in the holes of the top bolt clip assemblies 60, before the clips 60 are positioned in the channel 46. The clip assemblies 60 are then welded in place in the channel. An annular heater transition ring 120 is welded to an annular top inside flange 43 of the top clamping plate 40. Annular attachment ring 124 is welded to the squared-off portion 48 of the top clamping plate 40.

The top clamping plate 40 is then positioned on top of the ceramic members 10 in the annular array. The threaded portion of the bolts 72 are placed through the holes in the bottom bolt clip assemblies 61 and the springs 74. The nuts 76 are attached outside the springs and tightened. As the top clamping plate 40 is placed on the ceramic members the other end 121 of the heater transition ring 120 fits into annular gasket joint 122 attached to the base of the heater head tubes 220. A band joint 126 secures the attachment ring 124 to a annular flange 128 connected to a circular combustor structure (not shown). Both joints provide annular sealing.

The heat shield 130 is then placed in position over the preheater, heater head and combustor assemblies. The top annular outside flange 45 of the top clamping plate 40 fits into a gasket joint 132 on the inside surface 133 of the heat shield. The base of the heat shield has a flange 134 that sits on manifold ring 108 and annular flange 44 of the clamping plate. Band ring 136 clamps the flanges together and holds the heat shield in place.

The support structure described for the heat exchanger assembly also defines four annular manifolds, each isolated from the other manifolds and in flow communication with the flow ports on only one oblique face of the ceramic heat exchanger assembly. Annular manifold common wall 102 and air manifold ring 104 define the air inlet manifold 202. The annular attachment ring 124 and the radial inside surface 133 of the heat shield 134 define a preheated air manifold 204. Annular heater transition ring 120 and annular attachment ring 124 define hot combustion gas manifold 206. Annular manifold common wall 102 and exhaust manifold ring 108 define exhaust manifold 208.

By sealing the four flow manifolds 202, 204, 206 and 208 on the longitudinal inside of the heat exchanger assembly to the continuous annular flanges 42–45 of the clamping plates, and on the longitudinal outside to the squared-off portion 48 of the annular channel 46, all four different-temperature flows have been isolated from each other and from the other engine environments without sealing the gaps 38 between the ceramic members 10. Therefore the growth of those gaps due to the relative thermal expansion does not affect the flow stream sealing.

The operation of the invention as a counterflow preheater for a hot gas Stirling type engine will be described with reference to FIG. 5. Ambient temperature air from a blower (not shown) is communicated through air pipe 106 to the air inlet manifold 202. The air 210 enters the ceramic heat exchange matrix through apertures 50 and air inlet flow ports 34. The air flows through the heat exchange matrix in air flow passages (not shown) and gains heat from the adjacent heated ceramic material. The preheated air 212 then exits the ceramic heat exchange matrix at air exit flow ports 36 and apertures 50 into the preheated air manifold 204. The preheated air flows through passage 216 to the combustion chamber (not shown).

After combustion in the combustion chamber, the hot combustion gas 218 flows between the annular array of heater head tubes 220 into the hot combustion gas manifold 206. The hot combustion gas enters the ceramic heat exchange matrix through the apertures 50 and the gas inlet flow ports 35. The hot gas flows through the heat exchange matrix in gas passages 224 that are adjacent to the air passages (not shown). The gas flow is in the opposite direction of the air flow. The hot gas in gas passages 224 gives up heat to the heat exchange matrix to heat the ambient temperature air in the air passages. The cooled combustion gas 226 then exits the ceramic heat exchange matrix at gas exit flow ports 37 and apertures 50 to the exhaust manifold 208. From the exhaust manifold the coolded gas exits the engine by way of exhaust pipes 210.

This invention can be readily constructed at a low cost since it utilizes preassembled ceramic heat exchange matrix members that are compatible with bench assembly. Additionally, the clamping plates and the bolt clip assemblies can be readily fabricated.

This invention also allows thermal flexibility in that the spring loaded bolts allow relative growth between the metallic clamping plates and the ceramic heat exchange matrix without loss of the sealing function at the interface between them.

This invention also allows for low mass since the material required other than the basic heat exchange matrix for mounting and supporting the heat exchanger matrix is a minimal amount of low-mass sheet metal.

Other changes, variations, modifications of the embodiment disclosed in this invention will become apparent to those skilled in the art in light of the teachings. It is therefore to be understood that any modifications, variations and changes are believed to come within the scope of the invention as defined by the appended claims:

What is claimed is:

1. A heat exchanger assembly for exchanging heat between different temperature fluids in first and second flow paths comprising:

(a) at least one ceramic member having first fluid passages defining a heat exchange portion of said first flow path and second fluid passages defining a heat exchange portion of said second flow path, said ceramic member having a hexagonal cross-section such that the top and bottom of the ceramic member each have a pair of adjoining oblique faces which terminate in a squared-off portion forming a ridge therebetween, and each of said first and second fluid passages including inlet and exit flow ports disposed on said oblique faces;

(b) sealing material surrounding each inlet and exit port, and (c) mounting and sealing means for mounting said ceramic member in said first and second flow paths and sealing said first and second fluid passages in said first and second flow paths respectively whereby said mounting and sealing means is operative to adjust for different coefficients of thermal expansion between said ceramic member and said mounting means, said mounting and sealing means including:

(i) top and bottom compression members each having a portion adapted to define a channel of cross-section substantially the same as the pair of oblique faces of said ceramic member, said channel having a plurality of apertures therein ech disposed adjacent one of the inlet and exit flow ports with the sealing material therebetween whereby each flow port is sealed in flow communication with one of the apertures; and (ii) means for resiliently holding the channel portion of said compression member in compression against said pair of adjoining oblique faces of said ceramic member and the sealing material of each inlet and exit port thereof wherein said squared-off portion forming a ridge provides a clearance space between said ceramic member and said channel portion of said compression member during thermal expansion.

2. The heat exchanger assembly of claim 1, wherein said at least one ceramic member comprises a plurality of adjacent ceramic members disposed in a polygonal array and wherein said compression members comprise a top and bottom ring-shaped member and wherein said means for holding the channel portion of said compression member in compression includes a plurality of top and bottom clip assemblies, each clip assembly having a ring segment adapted to fit between adjacent ceramic members in the polygonal array and two attached wall portions adapted to abut the adjacent ceramic members and means for attaching the clip assembly to the channel portion of the compression member and a plurality of pre-loaded spring assemblies disposed outside each pair of top and bottom clip assemblies to hold the pair of clip assemblies in compression.

3. An annular heat exchanger assembly for a first fluid stream and a second fluid stream comprising:

a plurality of ceramic members each having substantially a hexagonal prism shape including two top and two bottom oblique faces and disposed in a near annular array a plurality of first fluid heat exchange passages in each ceramic member, each passage in flow communication between flow ports formed in two diagonally opposite oblique faces of the hexagonal prism;

a plurality of second fluid heat exchange passages in each ceramic member, each passage in flow communication between flow ports formed in the other two diagonally opposite oblique faces of the hexagonal prism;

top and bottom annular clamping plates, each plate including a central channel portion having a V-shaped cross-section configured to abut two adjoining oblique faces of the ceramic members;

a plurality of apertures disposed in the channel portion of the clamping plates, each aperture in flow communication with the flow ports of the adjacent oblique face;

a plurality of continuous gaskets, each positioned between the oblique faces of said ceramic member and the channel portion of said clamping plates and each completely surrounding an aperture in the channel portion;

means for resiliently holding the channel portion of said clamping plates against said gaskets and oblique faces to provide sealed flow communication for said first and second fluid streams and operative to compensate for the differential thermal expansion of said clamping plates and said ceramic members; and means for supporting said annular clamping plates such that said supporting means forms four annular manifolds, each manifold in sealed flow communication with the apertures and flow ports associated with one adjacent oblique face.

* * * * *